US011605482B2

(12) United States Patent
Yang et al.

(10) Patent No.: US 11,605,482 B2
(45) Date of Patent: Mar. 14, 2023

(54) THERMAL PROTECTED VARISTOR DEVICE

(71) Applicant: TDK Electronics AG, Munich (DE)

(72) Inventors: Wen Yang, Zhuhai (CN); Xiaojia Tian, Zhuhai (CN); Rongguang Zhang, Zhuhai (CN); Zilong Su, Deutschlandsberg (AT); Zhouquan He, Zhuhai (CN)

(73) Assignee: TDK ELECTRONICS AG, Munich (DE)

( * ) Notice: Subject to any disclaimer, the term of this patent is extended or adjusted under 35 U.S.C. 154(b) by 115 days.

(21) Appl. No.: 17/040,901

(22) PCT Filed: Apr. 3, 2019

(86) PCT No.: PCT/EP2019/058408
§ 371 (c)(1),
(2) Date: Sep. 23, 2020

(87) PCT Pub. No.: WO2019/193055
PCT Pub. Date: Oct. 10, 2019

(65) Prior Publication Data

US 2021/0012933 A1 Jan. 14, 2021

(30) Foreign Application Priority Data

Apr. 4, 2018 (CN) ..... 201810300480.1

(51) Int. Cl.
*H01C 7/12* (2006.01)
*H01C 1/022* (2006.01)
(Continued)

(52) U.S. Cl.
CPC ..... *H01C 7/126* (2013.01); *H01C 1/022* (2013.01); *H01C 1/144* (2013.01); *H01H 37/761* (2013.01); *H01H 2037/762* (2013.01)

(58) Field of Classification Search
CPC ..... H01C 7/126; H01C 1/022; H01C 1/144; H01H 37/761; H01H 2037/762
(Continued)

(56) References Cited

U.S. PATENT DOCUMENTS 2,770,390 A * 11/1956 Lisciani ..... B65D 90/22 220/88.1
6,323,750 B1 11/2001 Lampl et al.
(Continued)

FOREIGN PATENT DOCUMENTS

CN 2535906 Y 2/2003
CN 1738133 A * 2/2006
(Continued)

*Primary Examiner* — Kevin J Comber
(74) *Attorney, Agent, or Firm* — Slater Matsil, LLP

(57) ABSTRACT

In an embodiment a thermal varistor protection device includes a casing, a varistor embedded in the casing, wherein the varistor includes a first metallization electrode, which is only partly covered by an insulating material of the casing to allow an electrically conductive connection, a first terminal wire electrically conductively connected to the first metallization electrode of the varistor and a contact element electrically conductively connected to the first metallization electrode of the varistor in a region where the varistor is not covered by the insulating material, wherein the contact element is pre-stressed to ensure a fast separation of the contact element and the first metallization electrode when the electrically conductive connection between the contact element and the first metallization electrode becomes loose.

14 Claims, 2 Drawing Sheets

(51) Int. Cl.
*H01C 1/144* (2006.01)
*H01H 37/76* (2006.01)

(58) Field of Classification Search
USPC ..... 361/103
See application file for complete search history.

(56) References Cited

U.S. PATENT DOCUMENTS

| | | | | |
|---|---|---|---|---|
| 6,430,019 | B1 * | 8/2002 | Martenson | H01C 7/126 361/103 |
| 8,031,456 | B2 | 10/2011 | Wang | |
| 2007/0217111 | A1 | 9/2007 | Tseng | |
| 2010/0290168 | A1 | 11/2010 | Wang | |
| 2015/0171622 | A1 | 6/2015 | Lee et al. | |

FOREIGN PATENT DOCUMENTS

| | | | | |
|---|---|---|---|---|
| CN | 1925072 | A | 3/2007 | |
| CN | 101030466 | A | 9/2007 | |
| CN | 203026939 | U | 6/2013 | |
| CN | 203070854 | U | 7/2013 | |
| DE | 102013011646 | A1 | 1/2015 | |
| EP | 1098418 | A2 | 5/2001 | |
| JP | 2009218508 | A | 9/2009 | |
| WO | 2007142152 | A1 | 12/2007 | |
| WO | 2017139912 | A1 | 8/2017 | |
| WO | 2017140463 | A1 | 8/2017 | |
| WO | WO-2019071841 | A1 * | 4/2019 | H01C 7/12 |

* cited by examiner

THERMAL PROTECTED VARISTOR DEVICE

This patent application is a national phase filing under section 371 of PCT/EP2019/058408, filed Apr. 3, 2019, which claims the priority of Chinese patent application 201810300480.1, filed Apr. 4, 2018, each of which is incorporated herein by reference in its entirety.

TECHNICAL FIELD

The invention concerns a thermal protection device to protect an electrical element against overheating, for example a varistor.

BACKGROUND

In electrical circuits it is important to protect threatened electrical elements against overheating. A varistor is such an electrical element. The varistor can change from an electrically insulating state to an electrically conductive state with a characteristic current-voltage behaviour. On the one hand, if an overvoltage is applied to an electrical circuit, the varistor can protect the electrical circuit. On the other hand, the varistor has to be protected in turn when the overvoltage persists and a high current flows through the varistor.

SUMMARY

Embodiments provide a fast and reliable thermal protection device. Further embodiments provide a thermal protection device to protect a varistor in cases of overheating due to a persistently high voltage applied to the varistor over a certain time.

Embodiments relate to a thermal varistor protection device comprising a casing and a varistor which is embedded in the casing, wherein the varistor comprises a first metallization electrode, which is only partly covered by an insulating material of the casing to allow an electrically conductive connection to the first metallization electrode of the varistor. Furthermore the thermal varistor protection device comprises a first terminal wire that is electrically conductively connected to the first metallization electrode of the varistor. The thermal varistor protection device also comprises a contact element which is electrically conductively connected to the first metallization electrode of the varistor in a region where the varistor is not covered by the insulating material of the casing and wherein the contact element is pre-stressed to provide a fast separation of the contact element and the first metallization electrode if the electrical connection between the contact element and the first metallization electrode gets loose.

The varistor is protected against environmental influences and is largely electrically insulated as a result of being embedded by the insulating material of the casing. Therefore the varistor is protected against unwanted contact. Since the first metallization electrode is only partly embedded in the insulating material of the casing, an electrically conductive connection is possible. The pre-stressed contact element ensures a fast and secure separation of contact element and first metallization electrode. Therefore an improvement in the protection function is provided.

The pre-stress of the contact element can be caused by the contact element itself. In such a case the contact element would comprise an elastic part, which causes the pre-stress during an existent connection between the contact element and the first metallization electrode of the varistor.

Alternative the pre-stress can be caused by a separate element which is not part of the contact element. The separate element can be designed as a spring. The separate can be executed like a flat spring, a comprehension spring, an extension spring, a torsion spring, or the like.

If the pre-stress is caused by the contact element itself or by an elastic part of it, the thermal varistor protection device can be built in smaller dimensions, since no additional feature is needed to generate the pre-stress.

The electrically conductive connection between the first metallization electrode of the embedded varistor and the contact element can be realized as a low-temperature solder joint. Therein the low temperature would be a characteristic temperature at which the solder reaches a state where it would allow the pre-stress to interrupt the connection. The low temperature can be a characteristic temperature at which the solder becomes liquid.

A value of the characteristic temperature of the low-temperature solder can be in a range from 100° C. to 210° C. In a special embodiment the value of the characteristic temperature is 138° C.

By using such a low-temperature solder as described above, a thermally triggered interruption of a pre-stressed connection can be ensured. The triggering may be caused by a temperature increase of the varistor as well as by a high current which flows through the electrically conductive connection and heats it up. Both triggering mechanisms can be realized in the electrically conductive connection between the contact element and the first metallization electrode of the varistor, since the connection is close to the varistor and therefore shows a similar temperature behaviour, and the contact element and the connection are connected in series to the varistor and thus have the same current which flows through the varistor and which would heat up all the elements on the current path.

The casing can provide a feature to hold the contact element in place. If the pre-stress to the connection element is caused by a part of the connection element, it is possible to use the feature to build up the pre-stress. The feature can be designed in the form of a rivet. The feature can comprise more than one rivet.

Such a rivet can be part of the casing. In this case it would be possible to produce the rivet in one production step together with the casing itself. That would save production time and costs.

In one embodiment, if the electrically conductive connection between the first metallization electrode of the varistor and the contact element becomes loose, the pre-stress of the contact element pushes the contact element away from the region where the metallization electrode of the varistor is free from insulating material of the casing. The contact element can be pushed in a region where the metallization electrode of the varistor is covered by the insulating material of the casing. Thereby the contact element can get pushed against a wall of the casing by the pre-stress.

A local separation of contact element and metallization electrode can improve a save disconnection of those parts if the connection becomes loose. The separation by the pre-stress can lead to a fast separation, in addition. Here it is not important if the pre-stress is caused by a part of the contact element or by something else.

The first terminal wire can comprise a loop-like-shaped end which is electrically conductively connected to the first metallization electrode of the varistor. More specifically, the end can be shaped as an open loop or an open lug. This modification of the first terminal wire can increase a contact area between the first terminal wire and the metallization electrode of the varistor. As a result, the loop-like shape of the connected end of the first terminal wire can lead to an improved electrically conductive contact with higher stability and conductivity.

In one embodiment the contact element is a wire. Here the contact element can comprise an end which is electrically conductively connected to the metallization electrode of the varistor. For the same reasons as outlined above in view of an improved electrically conductive contact with higher stability and conductivity, it is possible to modify the connected end of the contact element, too.

The thermal varistor protection device can comprise a cap. The cap can be designed to be removably placed on the casing. Here the casing can define a cavity which is closed by the cap. Such a cavity would protect inner parts against environmental influences. The set of parts in the cavity can comprise the region on the metallization electrode of the varistor which is free from insulating material of the casing, a part of the contact element, the feature to hold the contact element, and the electrically conductive connection between the contact element and the metallization electrode of the varistor.

A general shape of the casing can be adjusted to the shape of the varistor. Therefore the casing can have a generally cuboid shape. An alteration of the casing can reduce the needed material to embed the varistor and therefore reduce costs.

The thermal varistor protection device can comprise a second terminal wire. The second terminal wire would be electrically conductively connected to a second metallization electrode of the varistor. Furthermore an arrangement of the second metallization electrode on the varistor at an opposite side to the first metallization electrode is possible.

DETAILED DESCRIPTION OF ILLUSTRATIVE EMBODIMENTS

Figure 1:
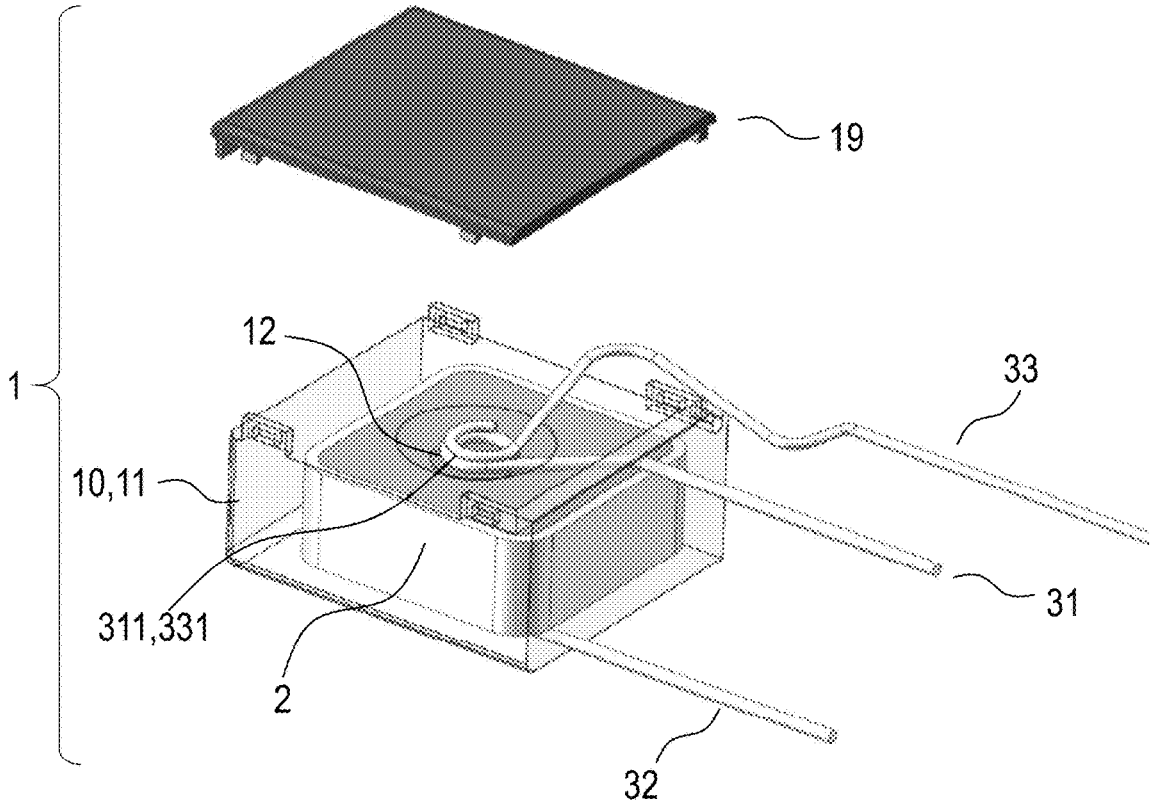
FIG. 1 shows a schematic perspective representation of a thermal varistor protection with a transparent casing.

The schematic representation of FIG. 1 gives a perspective view on an embodiment of a thermal varistor protection 1. A casing 10 is made from insulating material 11 and is represented transparent. In this casing a varistor 2 is embedded and is partly covered by the insulating material 11. In a region 12 which is free of the insulating material 11, the varistor 2 can be accessed for establishing an electrically conductive connection. The thermal varistor protection 1 comprises a cap 19 to cover a cavity in the casing 10 and to protect parts from environmental influences. A first terminal wire 31 and a second terminal wire 32 are electrically conductively connected to opposite sides of the varistor 2 and protrude from the casing 10. A contact element is electrically conductively connected to the varistor 2 in a region 12 which is free of the insulating material 11, and protrudes from the casing 10, too. In the shown embodiment the first terminal wire 31 and the contact element 33 are adjacent to one another and connected to the same side of the varistor 2 in the region 12 which is free of insulating material 11. Both the first terminal wire 31 and the contact element 33 have an open loop 311,331 at their respective ends connected to the varistor.

Figure 2:
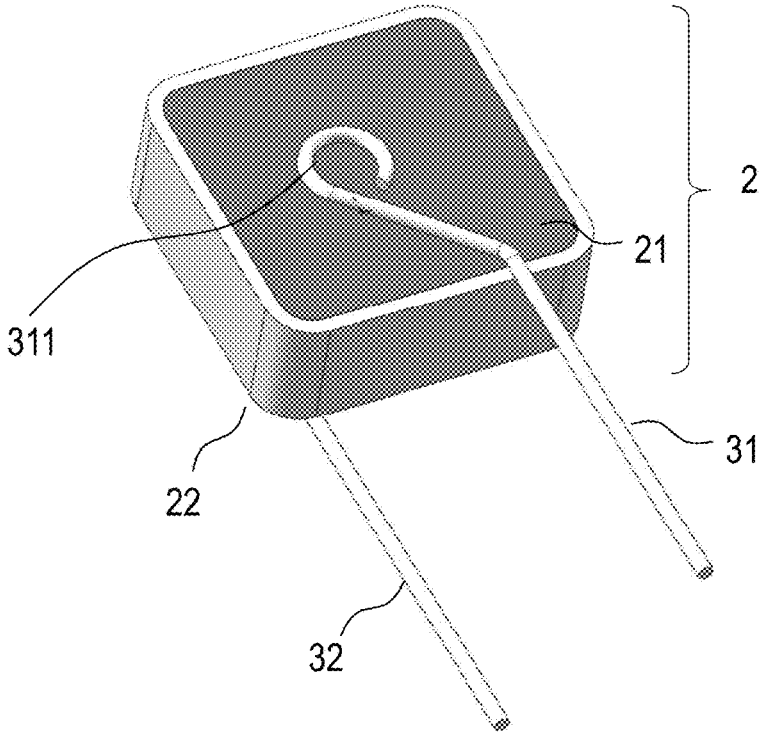
FIG. 2 shows a varistor which may be protected by the thermal varistor protection.

FIG. 2 shows a possible embodiment of a varistor 2 that would be the object of protection in a thermal varistor protection 1. The varistor 2 comprises a first metallization electrode 21, on which a first terminal wire 31 is electrically conductively connected. Furthermore, the varistor 2 of the shown embodiment has a second metallization electrode 22 (not visible) on the opposite side of the first metallization electrode 21. There is a second terminal wire 32, which is electrically conductively connected to the second metallization electrode 22 of the varistor 2.

A terminal wire that is connected to the varistor 2 can comprise an open loop at the connected end. In FIG. 2 the first terminal wire 31 shows an open loop 311 at its connected end. It should be mentioned that the cuboid-like shape of the varistor is an example only. A cylinder-like shape or other shapes are also possible for an embodiment of the protected varistor 2.

Figure 3:
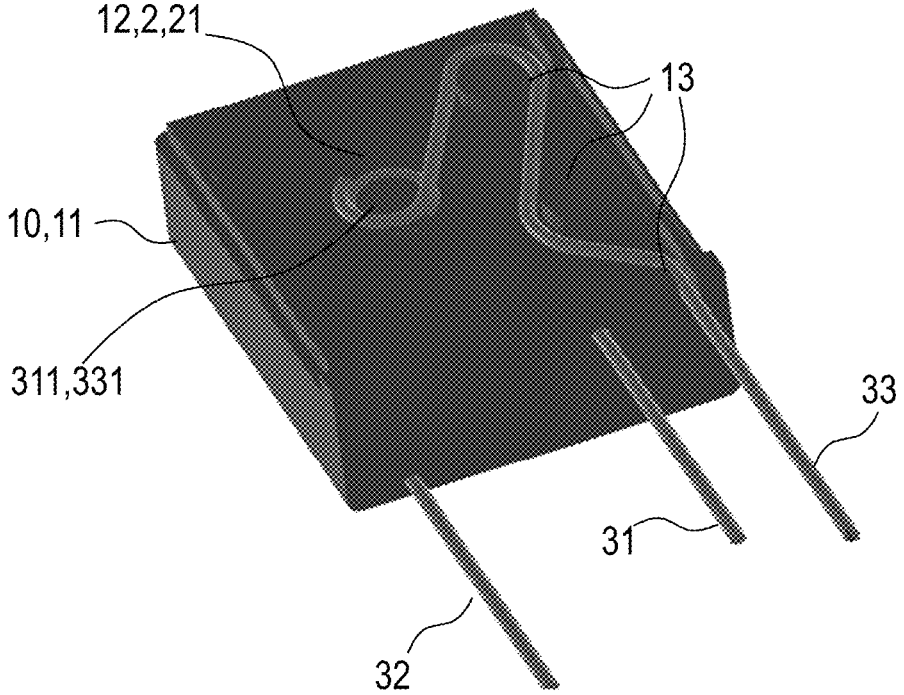
FIG. 3 shows a schematic perspective representation of a thermal varistor protection with an embedded varistor and a connected spring contact element.

FIG. 3 shows a schematic perspective of an embodiment of the thermal varistor protection 1 without a cap 19. In a casing 10 of insulating material 11 a varistor 2 is embedded. A first terminal wire 31 and a second terminal wire 32 are electrically conductively connected to two metallization electrodes on opposite sides of the varistor 2 and protrude out of the casing 10. The contact element 33 is electrically conductively connected to a metallization electrode 21 of the varistor adjacent to the point of connection of the first terminal wire 31, which is in a region 12 where the varistor 2 is free from insulating material 11. The casing 10 comprises features 13 to hold the contact element 33 and build up a pre-stress in the contact element 33. The features 13 can be a hinge. The contact element 33 is elastic to build up the pre-stress. The connection between the metallization electrode 21 of the varistor 2 and the contact element 33 can be realized with a low-temperature solder.

In cases of high voltage between the contact element 33 and the second terminal wire 32 the varistor 2 changes from an electrically insulating state to an electrically conductive state, and a high current flows through the varistor 2 and the connections at the varistor 2. If a high electrical current flows through a solder joint of a low-temperature solder, the solder gets heated up and becomes liquid. If the low-temperature solder in the connection between the metallization electrode 21 of the varistor 2 and the contact element 33 becomes liquid, the contact element 33 gets pushed away from the region 12 without insulating material 11 due to its inner pre-stress caused by the features 13 of the casing 10.

Figure 4:
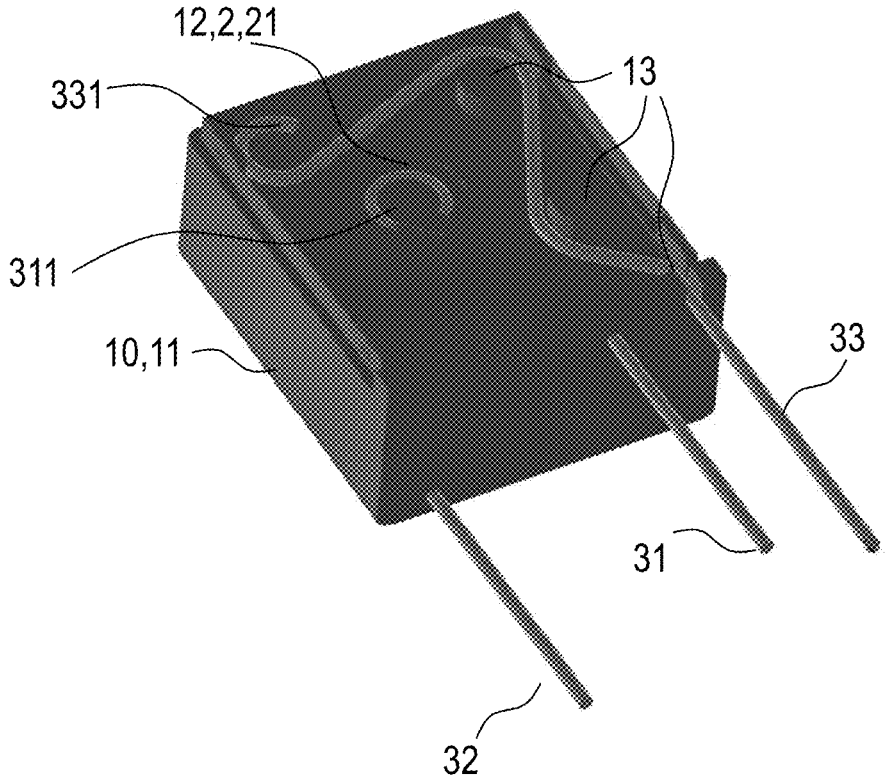
FIG. 4 shows a schematic perspective representation of a thermal varistor protection with an embedded varistor and a disconnected spring contact element.

FIG. 4 shows a case where the connection between a contact element 33 and the metallization electrode 21 of a varistor 2 embedded in the casing 10 has become loose. Due to the inner pre-stress of the contact element 33 and the loosened connection, the contact element 33 is pushed to a wall of a cavity in the casing 10 and away from a region 12 where the varistor 2 is free from electrically insulating material 11. The inner pre-stress of the contact element 33 is caused by a feature 13 of the casing 10 that has the additional function to hold the contact element 33 in its position, even if the connection to the metallization electrode 21 of the varistor 2 is undone. Both the terminal wire 31 and the contact element 33 have an open loop 311,331 at their respective ends which are supposed to be electrically conductively connected to the metallization electrode 21 of the varistor 2. The electrically conductive connection between the contact element 33 and the metallization electrode 21 of the varistor 2 can be realized with a low-temperature solder. If the low-temperature solder becomes liquid due to a high current that is caused by a high voltage which makes the varistor 2 switch from an electrically insulating state to an electrically conductive state, the inner pre-stress of the terminal 33 pushes the end with the open loop 331 against a wall of the cavity of the casing 10. As a result, the electrical connections between the contact element 33 and the varistor 2 and between the contact element 33 and the first terminal wire 31 become loose. This reaction protects the varistor against too much current and a resulting heating of the varistor, and it is possible to recognize a drop in voltage at the first terminal wire 31 by means of external signal processing.

The invention described here is not restricted by the description provided in connection with the exemplary embodiments. Rather, the invention encompasses any novel feature and any combination of features, including in particular any combination of features in the claims, even if this feature or this combination is not itself explicitly indicated in the claims or exemplary embodiments.

The invention claimed is:

1. A thermal varistor protection device comprising:

a casing;

a varistor embedded in the casing, wherein the varistor comprises a first metallization electrode, which is only partly covered by an insulating material of the casing to allow an electrically conductive connection;

a first terminal wire electrically conductively connected to the first metallization electrode of the varistor; and a contact element electrically conductively connected to the first metallization electrode of the varistor in a region where the varistor is not covered by the insulating material, wherein the contact element is pre-stressed to ensure a fast separation of the contact element and the first metallization electrode when the electrically conductive connection between the contact element and the first metallization electrode becomes loose, wherein a pre-stress is caused by a separate element which is not part of the contact element, and wherein the separate element is a spring.

2. The thermal varistor protection device according to claim 1, wherein the pre-stress is further caused by a part of the contact element itself, and wherein one part of the contact element is elastic.

3. The thermal varistor protection device according to claim 2, wherein the casing provides a feature configured to hold the contact element in place and to build up the pre-stress in an elastic part of the contact element.

4. The thermal varistor protection device according to claim 3, wherein the feature configured to hold the contact element in place and to build up the pre-stress in the contact element comprises rivets.

5. The thermal varistor protection device according to claim 1, wherein the electrically conductive connection between the first metallization electrode of the varistor and the contact element comprises a low-temperature solder joint, and wherein a low temperature is a characteristic temperature at which the solder joint reaches a state where it allows the pre-stress to interrupt a contact.

6. The thermal varistor protection device according to claim 5, wherein the characteristic temperature is a melting temperature of a solder, and wherein the melting temperature is in a range from 100° C. to 210° C.

7. The thermal varistor protection device according to claim 1, wherein the pre-stress of the contact element pushes the contact element against a wall of the casing away from the region where the varistor is not covered by the insulating material of the casing when the electrically conductive connection to the first metallization electrode of the varistor becomes loose.

8. The thermal varistor protection device according to claim 1, wherein the first terminal wire has an open loop at an end which is electrically conductively connected to the first metallization electrode of the varistor to increase a contact surface.

9. The thermal varistor protection device according to claim 1, wherein the contact element has an open loop at an end which is electrically conductively connected to the first metallization electrode of the varistor to increase a contact surface.

10. The thermal varistor protection device according to claim 1, wherein the casing comprises a cavity which is closed by a cap to protect inner parts against environmental influences.

11. The thermal varistor protection device according to claim 1, wherein the casing has generally a cuboid shape.

12. The thermal varistor protection device according to claim 1, further comprising a second terminal wire electrically conductively connected to a second metallization electrode of the varistor.

13. The thermal varistor protection device according to claim 1, wherein the casing comprises features, wherein one of the features holds the contact element in place and at least one other of the features is a hinge configured to build up the pre-stress in an elastic part of the contact element.

14. The thermal varistor protection device according to claim 1, wherein the pre-stress and a fixation of the contact element are configured to push the contact element away from the region of the first metallization electrode where the varistor is not covered by the insulating material in a movement parallel to a plane of the first metallization electrode.

* * * * *